US011483645B2

(12) United States Patent
Johnson et al.

(10) Patent No.: US 11,483,645 B2
(45) Date of Patent: Oct. 25, 2022

(54) ACOUSTIC TRANSDUCERS FOR MICROPHONE ASSEMBLIES HAVING NON-CIRCULAR APERTURES

(71) Applicant: Knowles Electronics, LLC, Itasca, IL (US)

(72) Inventors: Jeremy Johnson, Glen Ellyn, IL (US); Yenhao Chen, San Jose, CA (US)

(73) Assignee: Knowles Electronics, LLC, Itasca, IL (US)

( * ) Notice: Subject to any disclaimer, the term of this patent is extended or adjusted under 35 U.S.C. 154(b) by 243 days.

(21) Appl. No.: 16/894,608

(22) Filed: Jun. 5, 2020

(65) Prior Publication Data

US 2020/0389723 A1 Dec. 10, 2020

Related U.S. Application Data

(60) Provisional application No. 62/858,957, filed on Jun. 7, 2019.

(51) Int. Cl.

| | |
|---|---|
| ***H04R 1/36*** | (2006.01) |
| ***H04R 19/00*** | (2006.01) |
| ***H04R 19/04*** | (2006.01) |

(52) U.S. Cl.

CPC ..... *H04R 1/36* (2013.01); *H04R 19/005* (2013.01); *H04R 19/04* (2013.01)

(58) Field of Classification Search

CPC ..... H04R 1/36; H04R 19/005; H04R 19/04
See application file for complete search history.

(56) References Cited

U.S. PATENT DOCUMENTS

| | | | |
|---|---|---|---|
| 2008/0031476 | A1 | 2/2008 | Wang |
| 2010/0158280 | A1 | 6/2010 | Coronato et al. |
| 2012/0266686 | A1 | 10/2012 | Huffman |
| 2017/0055085 | A1 | 2/2017 | Wang |

FOREIGN PATENT DOCUMENTS

| | | |
|---|---|---|
| CN | 1589587 | 3/2005 |
| CN | 101828409 | 9/2010 |
| CN | 102984632 | 3/2013 |
| CN | 104602173 | 5/2015 |
| CN | 105359553 | 2/2016 |
| CN | 105519137 | 4/2016 |
| CN | 205847597 | 12/2016 |
| CN | 109729483 | 5/2019 |
| KR | 20140067238 | 6/2014 |
| KR | 20190016718 A1 | 2/2019 |

OTHER PUBLICATIONS

He, References cited, Application No. 202010492927.7, China National Intellectual Property Administration, Beijing, CN, Jun. 4, 2021.

Wang, References cited, Application No. 202010492927.7, China National Intellectual Property Administration, Beijing, Dec. 13, 2021.

*Primary Examiner* — David L Ton
(74) *Attorney, Agent, or Firm* — Loppnow & Chapa; Matthew C. Loppnow

(57) ABSTRACT

An acoustic transducer comprises a transducer substrate, and an aperture having a non-circular perimetral shape defined through the transducer substrate. A diaphragm is disposed on the transducer substrate and coupled to a surface of the transducer substrate via at least one diaphragm anchor such that a gap is defined between the diaphragm and the transducer substrate, and an outer periphery of the diaphragm extends radially outwards of a rim of the aperture such that a portion of the diaphragm overhangs the aperture.

18 Claims, 7 Drawing Sheets

ACOUSTIC TRANSDUCERS FOR MICROPHONE ASSEMBLIES HAVING NON-CIRCULAR APERTURES

TECHNICAL FIELD

The present disclosure relates generally to acoustic transducers for microphone assemblies having non-circular apertures.

BACKGROUND

Microphone assemblies are used in electronic devices to convert acoustic energy to electrical signals. Advancements in micro and nanofabrication technologies have led to the development of progressively smaller micro-electro-mechanical-system (MEMS) microphone assemblies. Some microphone assemblies include acoustic transducers that have a diaphragm that overhangs the aperture, and may seal a rim of the aperture when exposed to excessive pressure which can lead to failure of the diaphragm and thereby, the acoustic transducer.

SUMMARY

In some embodiments, an acoustic transducer comprises a transducer substrate, and an aperture having a non-circular perimetral shape defined through the transducer substrate. A diaphragm is disposed over the transducer substrate and coupled to a surface of the transducer substrate via at least one diaphragm anchor such that a gap is defined between the diaphragm and the transducer substrate. An outer edge of the diaphragm is located radially outwards of a rim of the aperture such that a portion of the diaphragm overhangs the aperture.

In some embodiments, a microphone assembly comprises a base. An enclosure is disposed on the base. An acoustic transducer is disposed on the base within the enclosure, and is configured to generate an electrical signal responsive to acoustic activity. The acoustic transducer comprises a transducer substrate, and an aperture having a non-circular perimetral shape defined through the transducer substrate. A diaphragm is disposed over the transducer substrate and is coupled to a surface of the transducer substrate via at least one diaphragm anchor such that a gap is defined between the diaphragm and the transducer substrate, and an outer edge of the diaphragm is located radially outwards of a rim of the aperture such that a portion of the diaphragm overhangs the aperture.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
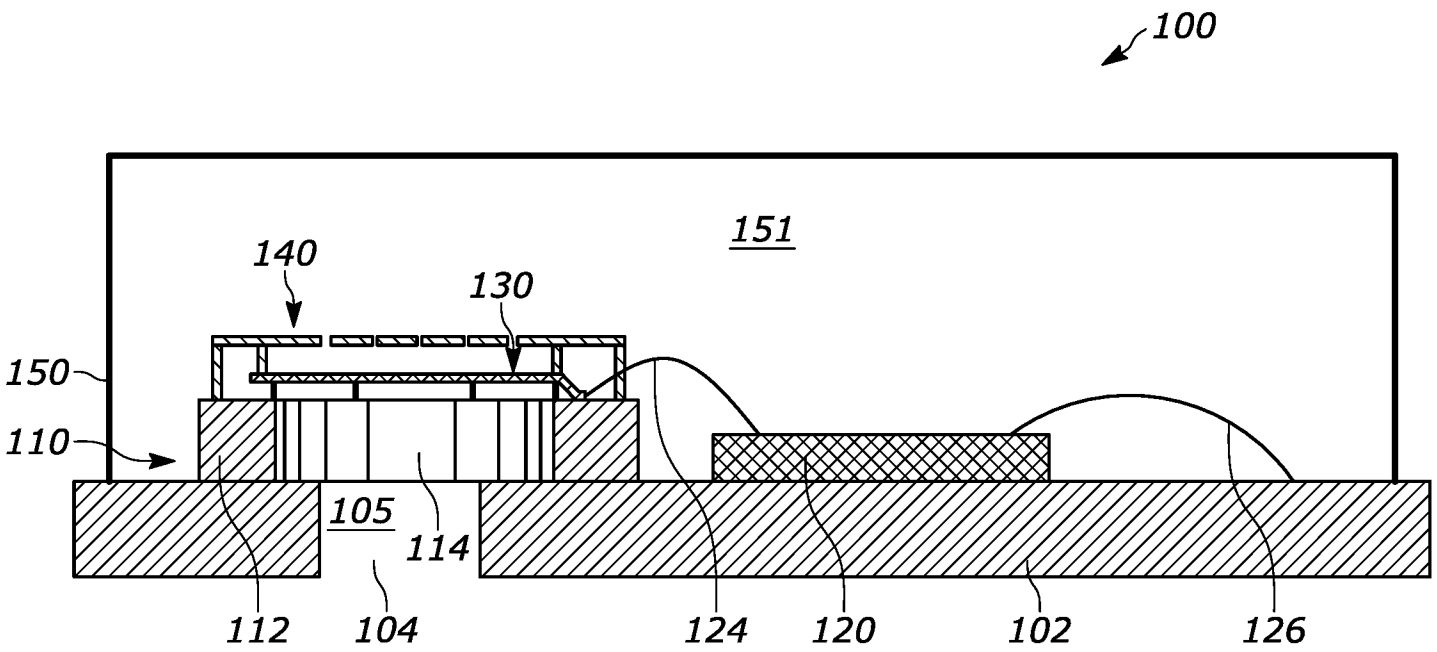
FIG. 1 is a side cross-section view of a microphone assembly including an acoustic transducer, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Embodiments described herein relate generally to acoustic transducers, and microphone assemblies including acoustic transducers that have an aperture having a non-circular perimetral shape defined in a transducer substrate thereof. The non-circular shape is configured to enable air to flow between a front volume and a back volume of the microphone even when excessive pressure within the internal volume of the microphone assembly causes the diaphragm to bend and contact a rim of the aperture. This prevents failure of the diaphragm due to excessive air pressure.

Small MEMS microphone assemblies have allowed incorporation of such microphone assemblies in compact devices such as cell phones, laptops, wearables, TV/set-top box remotes, etc. Some microphone assemblies include acoustic transducers that have a diaphragm disposed on a transducer substrate. Generally, a circular aperture is defined in the transducer substrate to allow acoustic signals to be communicated therethrough to the diaphragm. Some acoustic transducers include diaphragms that are suspended over the aperture and may extend radially beyond a rim of the aperture, i.e., the diaphragm has a larger cross-sectional dimension (e.g., diameter) than the aperture, such that a portion the diaphragm overhangs the aperture. Pressure fluctuations due to air compression in a back volume of the microphone assembly may cause the diaphragm to flex towards the aperture. A gap may be present between the diaphragm and a rim of the aperture and/or a pierce may be defined in the diaphragm to provide pressure equalization between front and back volumes of the microphone assembly.

Since the diaphragm is suspended over the aperture and extends radially outwards of a rim of the aperture, vibration of the diaphragm causes the diaphragm to move towards the rim of the aperture. During normal operation of the acoustic transducer, the pressure is generally not sufficiently large to cause the diaphragm to flex to an extent such that the diaphragm contacts the rim of the aperture, and pressure equalization can occur via air flow through the gap and/or pierce. However, in some high pressure events, such as during an airburst test of the microphone assembly, or heating of the microphone assembly (e.g., due to soldering of an enclosure of the microphone assembly to a base thereof), pressure buildup may occur in the enclosure causing an air pressure load sufficient to cause the diaphragm to bend towards and contact the rim of the aperture. This causes the diaphragm to seal the rim of the circular aperture such that pressure equalization between the front and back volumes of the microphone assembly cannot occur and cannot be overcome by the pierce alone, such that the entire load is applied on the diaphragm. This can lead to failure of the diaphragm.

In contrast, embodiments of the acoustic transducers described herein may provide one or more benefits including, for example: (1) providing an aperture in the acoustic transducer that has a non-circular perimetral shape such that even during high pressure events when the diaphragm contacts the rim of the aperture, the rim of the aperture is not completely sealed by the diaphragm enabling pressure equalization during such events; (2) having a sinusoidal function define the non-circular perimetral shape such that peaks and valleys defined in a wall of the aperture have curved ends that prevent stress concentration on the diaphragm when the diaphragm contacts the rim of the aperture; and/or (3) increasing a survival percentage of such acoustic transducers at higher pressures (e.g., pressures greater than 80 psi) relative to acoustic transducers that include circular apertures.

Figure 2A:
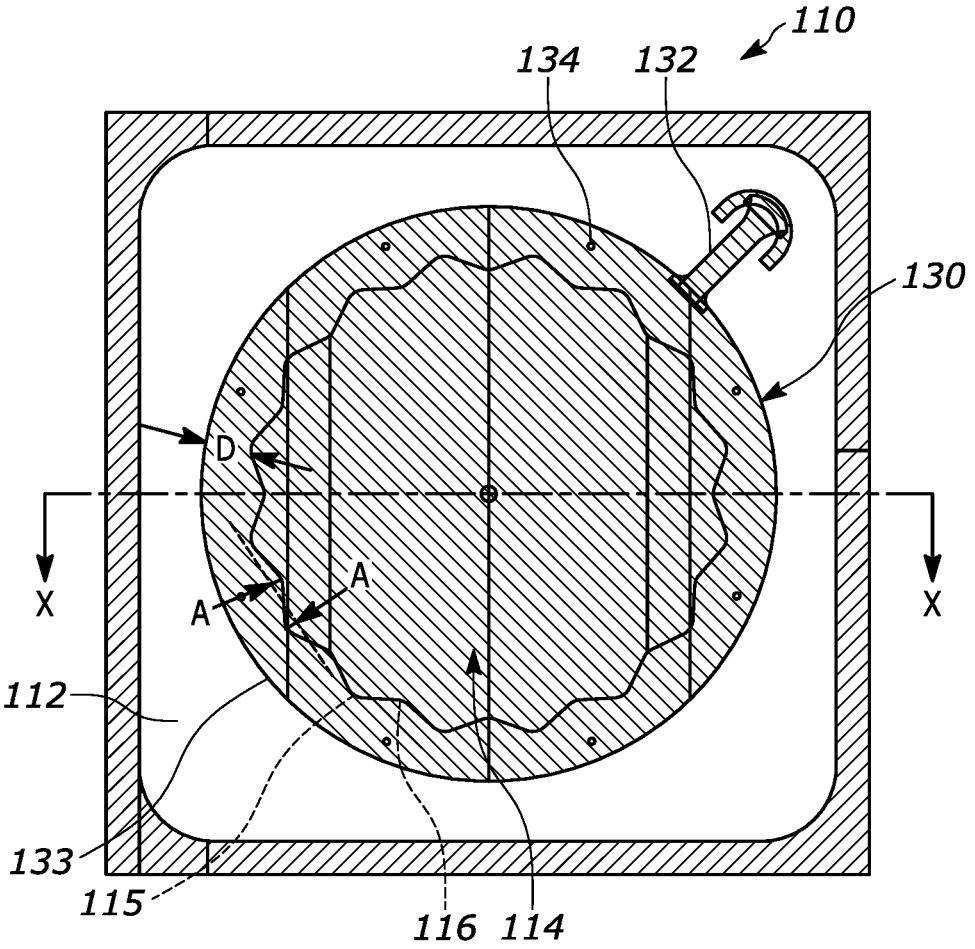
FIG. 2A is top plan view of a portion of the acoustic transducer of FIG. 1.
Figure 2B:
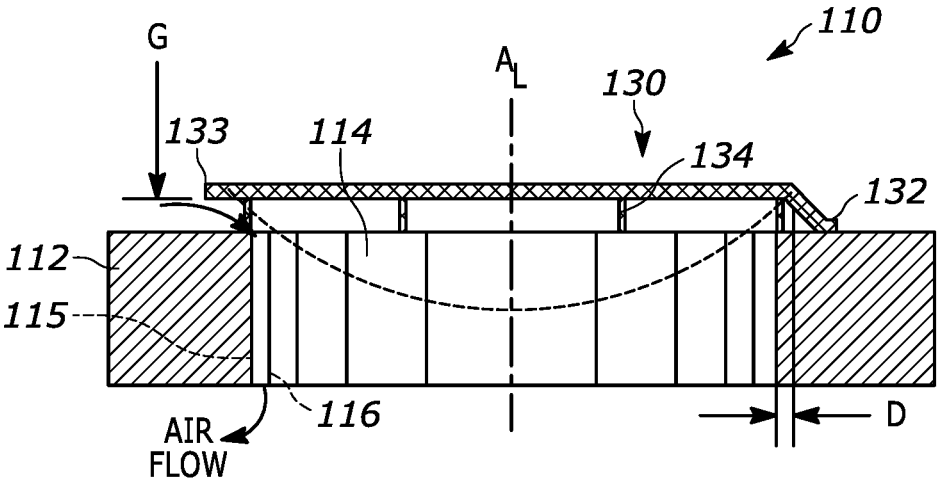
FIG. 2B is a side cross-section view of the portion of the acoustic transducer of FIG. 2A.
Figure 3:
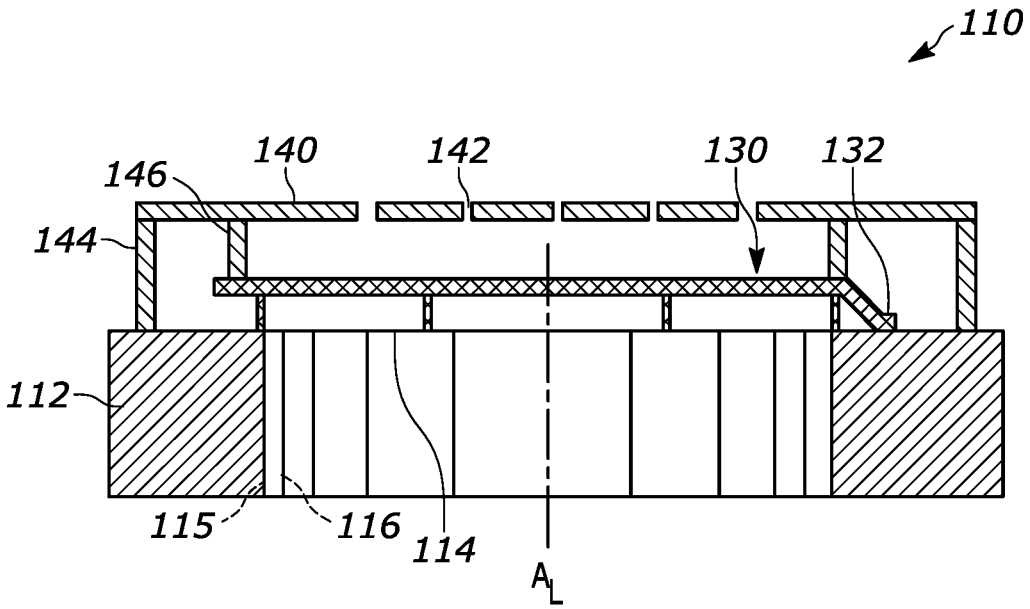
FIG. 3 is another side cross-section view of the acoustic transducer of FIGS. 1 and 2A-2B including showing the back plate included therein.

Referring now to FIGS. 1-3, a microphone assembly 100 is shown, according to an embodiment. The microphone assembly 100 may be used for converting acoustic signals into electrical signals in any device such as, for example, cell phones, laptops, TV/set top box remotes, tablets, audio systems, head phones, wearables, portable speakers, car sound systems or any other device which uses a microphone assembly.

The microphone assembly 100 includes a base 102, an acoustic transducer 110 disposed on the base 102, an integrated circuit 120, and an enclosure or cover 150. The base 102 can be formed from materials used in printed circuit board (PCB) fabrication (e.g., plastics). For example, the base 102 may include a PCB configured to mount the acoustic transducer 110, the integrated circuit 120, and the enclosure 150 thereon. A sound port 104 is formed through the base 102. The acoustic transducer 110, described in further detail herein, is positioned on the sound port 104, and is configured to generate an electrical signal responsive to an acoustic signal received through the sound port 104.

In FIG. 1, the acoustic transducer 110 and the integrated circuit 120 are shown disposed on a surface of the base 102, but in other embodiments one or more of these components may be disposed on the enclosure 150 (e.g., on an inner surface of the enclosure 150) or sidewalls of the enclosure 150 or stacked atop one another. In some embodiments, the base 102 includes an external-device interface having a plurality of contacts coupled to the integrated circuit 120, for example, to connection pads (e.g., bonding pads) which may be provided on the integrated circuit 120. The contacts may be embodied as pins, pads, bumps or balls among other known or future mounting structures. The functions and number of contacts on the external-device interface depend on the protocol or protocols implemented and may include power, ground, data, and clock contacts among others. The external-device interface permits integration of the microphone assembly 100 with a host device using reflow-soldering, fusion bonding, or other assembly processes.

As shown in FIG. 1, the acoustic transducer 110 includes a diaphragm 130 that separates a front volume 105 defined between the diaphragm 130 and the sound port 104, from a back volume 151 of the microphone assembly 100 between the enclosure 150 and diaphragm 130. The embodiment shown in FIG. 1 includes a bottom port microphone assembly 100 in which the sound port 104 is defined in the base 102 such that the internal volume 151 of the enclosure 150 defines the back volume. It should be appreciated that in other embodiments, the concepts described herein may be implemented in a top port microphone assembly in which a sound port is defined in the enclosure 150 of the microphone assembly 100.

In some embodiments, a pierce or throughhole (not shown) is defined through the diaphragm 130 to provide pressure equalization between the front and back volumes 105, 151. In other embodiments, a vent may be defined in the enclosure 150 to allow pressure equalization.

The integrated circuit 120 is positioned on the base 102. The integrated circuit 120 is electrically coupled to the acoustic transducer 110, for example, via a first electrical lead 124, and to the base 102 (e.g., to a trace or other electrical contact disposed on the base 102) via a second electrical lead 126. The integrated circuit 120 receives an electrical signal from the acoustic transducer 110 and may amplify and condition the signal before outputting a digital or analog electrical signal as is known generally. The integrated circuit 120 may also include a protocol interface (not shown), depending on the output protocol desired. The integrated circuit 120 may also be configured to permit programming or interrogation thereof as described herein. Exemplary protocols include but are not limited to PDM, PCM, SoundWire, I2C, I2S and SPI, among others.

The integrated circuit 120 may include one or more components, for example, a processor, a memory, and/or a communication interface. The processor may be implemented as one or more general-purpose processors, an application specific integrated circuit (ASIC), one or more field programmable gate arrays (FPGAs), a digital signal processor (DSP), a group of processing components, or other suitable electronic processing components. In other embodiments, the DSP may be separate from the integrated circuit 120 and in some implementations, may be stacked on the integrated circuit 120. In some embodiments, the one or more processors may be shared by multiple circuits and, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on.

The enclosure 150 is positioned on the base 102. The enclosure 150 defines the internal volume 151 within which at least the integrated circuit 120 and the acoustic transducer 110 is positioned. For example, as shown in FIG. 1, the enclosure 150 is positioned on the base 102 such that the base 102 forms a base of the microphone assembly 100, and the base 102 and the enclosure 150 cooperatively define the internal volume 151. As previously described herein, the internal volume 151 defines the back volume of the microphone assembly 100.

The enclosure 150 may be formed from a suitable material such as, for example, metals (e.g., aluminum, copper, stainless steel, etc.), and may be coupled to the base 102, for example, via an adhesive, soldered or fusion bonded thereto.

As shown in FIG. 1, the acoustic transducer 110 includes a transducer substrate 112 disposed on the base 102. In some embodiments, the transducer substrate 112 may be formed from silicon, glass, ceramics, or any other suitable material. The transducer substrate 112 defines an aperture 114. The diaphragm 130 is disposed on transducer substrate 112 over the aperture 114. The diaphragm 130 may be formed from any suitable material, for example, silicon, polysilicon, silicon nitride, etc. A back plate 140 may be disposed over the substrate (described in further detail with respect to FIG. 3).

FIG. 2A is a top plan view, and FIG. 2B is a side cross-section view of the acoustic transducer 110 with the back plate 140 removed for clarity. The diaphragm 130 is disposed over the transducer substrate 112. A diaphragm anchor 132 extends downwards from a rim of the diaphragm 130 towards the transducer substrate 112 and is coupled to a surface of the transducer substrate 112. This causes the diaphragm 130 to be spaced apart from the transducer substrate 112 such that gap G is defined between the diaphragm 130 and the transducer substrate 112. In some embodiments, an axial distance between the diaphragm 130 and the transducer substrate 112 defined by the gap G is in a range of 0.5 microns to 3 microns (e.g., 0.5, 1.0, 1.5, 2.0, 2.5, or 3.0 microns, inclusive). It should be appreciated that while various embodiments herein describe the diaphragm as 130 as being spaced apart from the transducer substrate 112, in other embodiments, the diaphragm 130 or any other diaphragm described herein may be disposed on the transducer substrate 112 such that there is no gap between the diaphragm 130, and the transducer substrate 112.

While not shown, in some embodiments, a pierce may also be defined through the diaphragm 130. The gap G and the pierce facilitate pressure equalization between the front volume 105 and back volume 151 of the microphone assembly 100 during operation of the microphone assembly 100. In some embodiments, a plurality of anchor posts 134 are also disposed on the transducer substrate 112 circumferentially around a rim of the aperture 114. The anchor posts 134 may be formed from the same material as the transducer substrate 112 and extend from the transducer substrate 112 towards the diaphragm 130 and may be in constant contact therewith, or configured to contact the diaphragm 130 when the diaphragm 130 is exposed to pressure. The anchor posts 134 provide additional support to the diaphragm 130 in addition to the diaphragm anchor 132.

As shown in FIGS. 2A-2B, an outer edge 133 of the diaphragm 130 is located radially outwards of a rim of the aperture 114 such that a portion of the diaphragm 130 overhangs the aperture 114. In other words, a diameter of the diaphragm 130 is larger than a maximum cross-sectional dimension of the aperture 114 such that an outer edge of the diaphragm 130 extends radially beyond a rim of the aperture 114 in a direction perpendicular to the longitudinal axis $A_L$. In some embodiments, a radial distance D from the outer edge 133 of the diaphragm 130 to the rim of the aperture 114 is in a range of 5 microns to 70 microns (e.g., 5, 10, 15, 20, 30, 40, 50, 60, or 70 microns, inclusive).

As previously described herein, large pressure events (e.g., an air burst pressure test, or heating of the air in the back volume 151 due to soldering of the enclosure 150 to the base 102) may cause substantial increase air pressure contained in the back volume 151 (e.g., a pressure of greater than 80 psi). For example, an air burst test may exert a large air pressure on an outer surface of the enclosure 150 that is exposed to the environment. This causes the enclosure 150 to flex or compress, thereby decreasing a volumetric capacity of back volume 151. The air inside the back volume 151 exerts a large pressure (e.g., greater than 80 psi) on the diaphragm 130, which causes the diaphragm 130 to flex towards the transducer substrate 112. In conventional acoustic transducers in which the aperture defines a circular perimetral shape, such high pressure events can cause the diaphragm 130 to contact and seal the rim of the circular aperture, thereby preventing pressure equalization which can lead to failure of the diaphragm 130.

In contrast, the aperture 114 defined through the transducer substrate 112 has a non-circular perimetral shape which prevents the diaphragm 130 from completely sealing the rim of the aperture 114 even though the diaphragm 130 may contact a portion of the rim. This allows pressure equalization between the front volume 105 and the back volume 151 to occur even though the diaphragm 130 is contacting the portion of the rim of the aperture 114, therefore reducing pressure on the diaphragm 130 and preventing failure thereof.

In some embodiments, the aperture 114 defines a wavy shape, for example, defined by peaks and valleys having a hemispherical shape. In other embodiments, as shown in FIG. 2A, the non-circular perimetral shape defined by the aperture 114 is a sinusoidal shape (i.e., represented by a sinusoidal function) such that a wall of the aperture 114 defines a set of peaks 115 and a corresponding set of valleys 116 in a direction perpendicular to a longitudinal axis $A_L$ of the acoustic transducer 110. While the aperture 114 is shown in FIGS. 1-4 as having a constant cross-section along the longitudinal axis $A_L$, in other embodiments, the aperture 114 may have a tapered cross-section, in still other embodiments, the aperture 114 may have a variable cross-section along the longitudinal axis $A_L$. For example, the aperture 114 may define a wavy or sinusoidal shaped cross-section from an end of the aperture 114 proximate to the diaphragm 130 up to a predetermined length of the aperture 114 (e.g., 5, 10, 15, 20, or 25 microns, inclusive), and then onwards define a circular cross-section to the opposite end of the aperture 114.

As shown in FIG. 2B, when a high pressure event (e.g., an air burst event) causes the diaphragm 130 to deflect towards and contact the aperture 114, the diaphragm 130 contacts the aperture 114 at a tip the valleys 116, but does not seal the aperture 114 because there is still space for air to flow through from the back volume 151 to the front volume 105 through a space provided between the peaks of the aperture 114 and the edge of the diaphragm 130. Therefore, air pressure is still able to equalize between the back volume 151 and the front volume 105 of the microphone assembly 100. Furthermore, the curved shape of each valley 116 prevents the impact force on the diaphragm 130 (due to the diaphragm 130 contacting the aperture 114) from being concentrated on a point location of the diaphragm 130 and instead, spreads the force over a larger area. This prevents stress concentration reducing the likelihood of the diaphragm 130 cracking when it contacts the tip of the valleys 116.

In some embodiments, an amplitude of the sinusoidal shape defined by the aperture 114 is in a range of 5 microns to 50 microns, inclusive. In other words, as shown in FIG. 2A, an amplitude A of each peak 115 and each valley 116 defined by the sinusoidal function measured from a central axis of the sinusoidal function is in a range of 5 microns to 50 microns (e.g., 5, 10, 15, 20, 25, 30, 35, 40, 45, or 50 microns, inclusive).

In some embodiments, an angular frequency of the set of peaks 115 and the set of valleys 116 is in a range of 90 degrees per oscillation to 42 degrees per oscillation of the sinusoidal function defining the sinusoidal shape (e.g., 4, 6, 8, 12, 16, 18, 20, 24, 28, 30, 32, 36, 40, 42, 44, 48, 52, 54, 56, 60, 64, 66, 68, or 72 degrees per oscillation, inclusive). In other words, each peak 115 and each valley 116 is separated from an adjacent peak 115 and an adjacent valley 116, respectively by an angle in a range of 5 degrees to 90 degrees, inclusive. The frequency defines the number of peaks 115 and valleys 116 that are defined in the aperture 114, for example, the aperture 114 may define in range of 4 to 72 peaks 115 and a corresponding number of valleys 116 based on the angular frequency.

In some embodiments, each anchor post 134 of the plurality of anchor posts 134 is radially aligned with a corresponding valley 116 of the set of valleys 116, as shown in FIG. 2A. In other embodiments, each anchor post 134 of the plurality of anchor posts may be radially aligned with a corresponding peak 115 of the set of peaks 115.

As previously described herein and also shown in FIG. 3, the acoustic transducer 110 also includes the back plate 140 disposed on the transducer substrate 112 over the diaphragm 130. The back plate 140 may be formed from polysilicon, silicon nitride, or any other suitable materials (e.g., silicon oxide, silicon, ceramics, etc.), or layers (e.g., interposed layers) thereof. A plurality of back plate openings 142 are defined through the back plate 140 so as to allow the air contained in the back volume 151 to be in fluid communication with the diaphragm 130 through the back plate 140. In some embodiments as shown in FIG. 3, the back plate 140 includes back plate edge anchors 144 extending from a peripheral edge of the back plate 140 and coupled to the transducer substrate 112. In addition, back plate posts 146 extend from a surface of the back plate 140 facing the diaphragm 130, towards the diaphragm 130. The back plates posts 146 may be in contact with the diaphragm 130 or spaced apart therefrom and may serve to limit a motion of the diaphragm 130 relative to the back plate 140. Vibrations of the diaphragm 130 relative to the back plate 140 which is substantially fixed (e.g., substantially inflexible relative to the diaphragm 130) in response to acoustic signals received on the diaphragm 130 causes changes in the capacitance between the diaphragm 130 and the back plate 140, and corresponding changes in the generated electrical signal.

Figure 4:
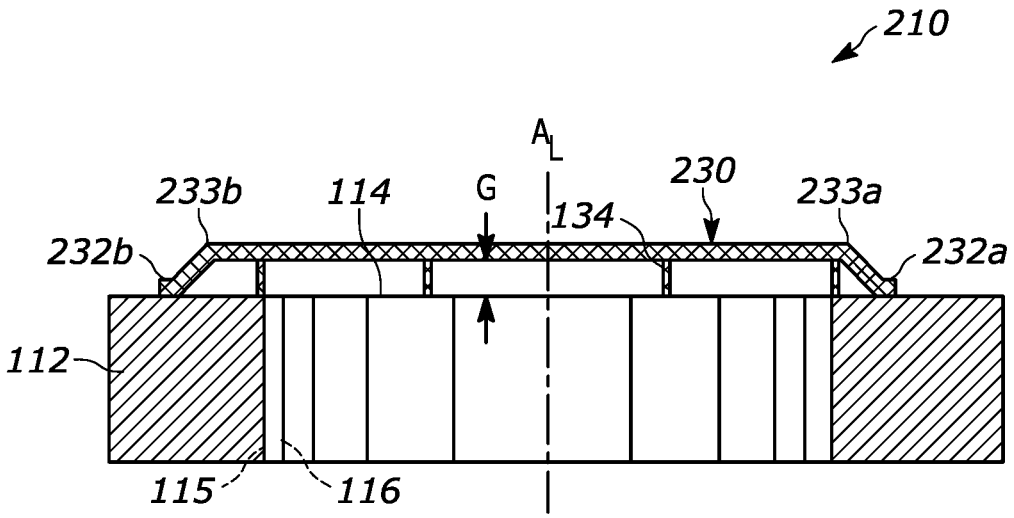
FIG. 4 is a side cross-section view of an acoustic transducer, according to another embodiment.

While FIGS. 1-3 show the acoustic transducer 110 that includes the diaphragm 130 having a single diaphragm anchor 132, in other embodiments, an acoustic transducer may include a diaphragm having a plurality of diaphragm anchors. For example, FIG. 4 is a side cross-section view of an acoustic transducer 210, according to another embodiment. A back plate (e.g., the back plate 140) which may be included in the acoustic transducer 210 is not shown for clarity. The acoustic transducer 210 includes the transducer substrate 112 defining the aperture 114 having the non-circular perimetral shape, as previously described herein. A diaphragm 230 is disposed over the transducer substrate 112 similar to the acoustic transducer 110. However, different from the diaphragm 130, the diaphragm 230 includes a first diaphragm anchor 232*a* extending from a first location 233*a* of a radially outer edge of the diaphragm 230 towards the transducer substrate 112 and coupled thereto. Furthermore, a second diaphragm anchor 232*b* extends from a second location 233*b* of the outer edge of the diaphragm 230 towards the transducer substrate 112 and is also coupled thereto such that the diaphragm 230 is suspended over the transducer substrate 112 via the first and second diaphragm anchors 232*a/b*. While FIG. 4 shows the first and second diaphragm anchors 232*a/b* being located opposite each other, i.e., offset by an angle of approximately 180 degrees, in other embodiments, the first and second diaphragm anchors 232*a/b* may be located at any suitable location relative to each other. Furthermore, the diaphragms 130, 230 or any other diaphragm described herein may include any number of diaphragm anchors, for example, 3, 4, 5, 6 or even more.

Figure 5:
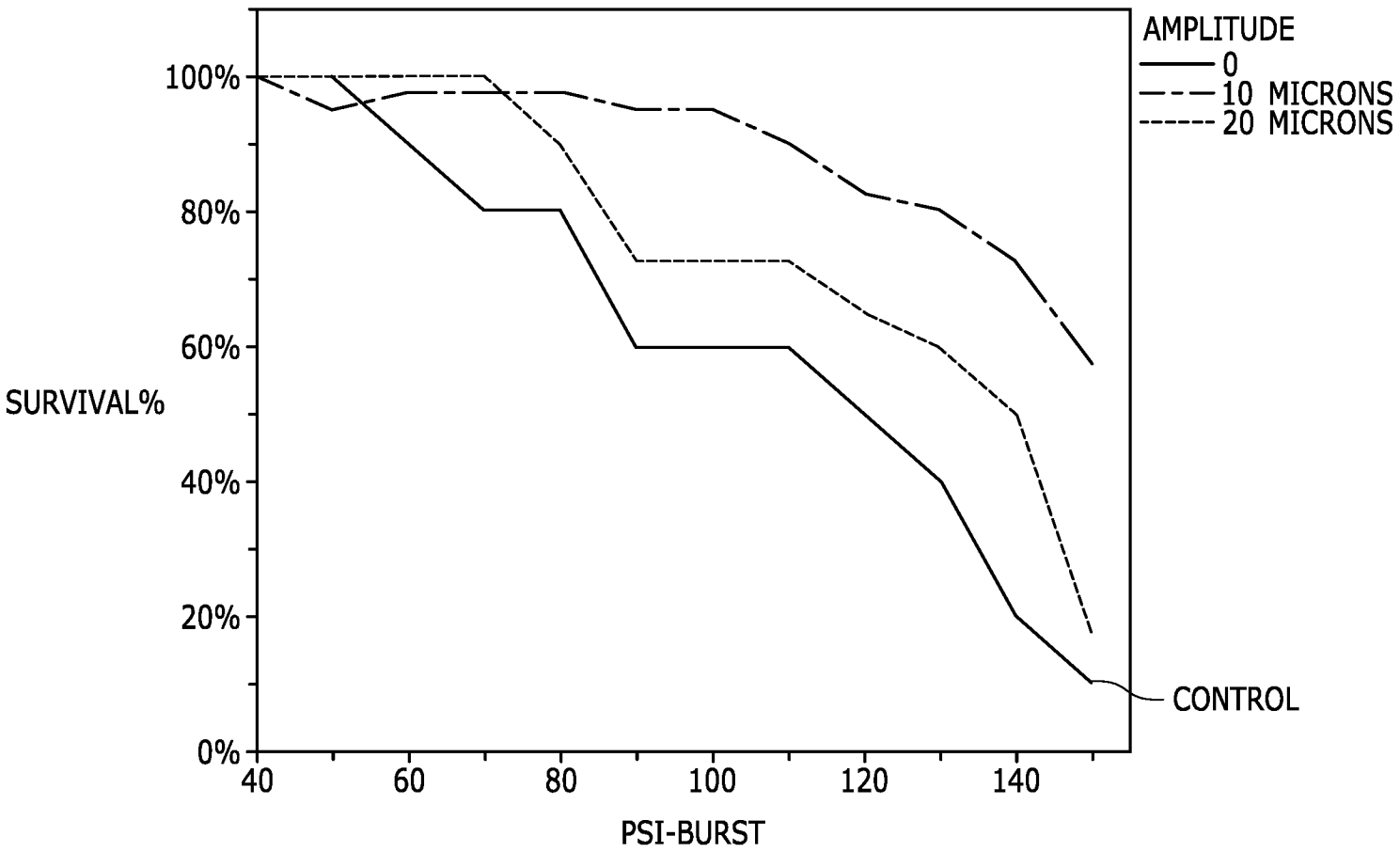
FIG. 5 are plots showing survival rates of diaphragms of acoustic transducers that include a circular aperture (control), or an aperture defining a non-circular perimetral shape represented by a sinusoidal function having an amplitude of either 10 or 20 microns, in response to an air pressure burst.
Figure 6:
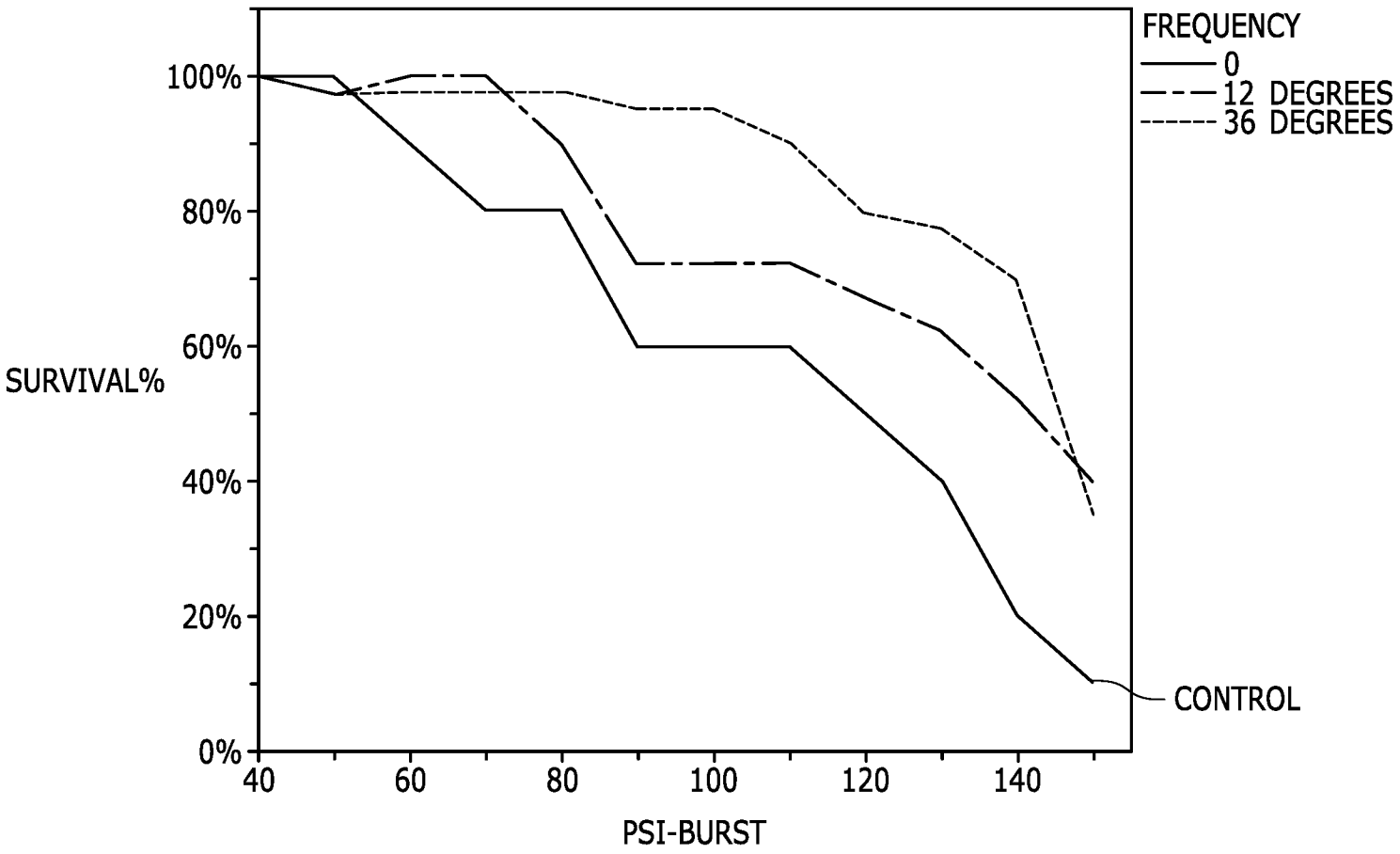
FIG. 6 are plots showing survival rates of diaphragms of acoustic transducers that include a circular aperture (control), or an aperture defining a non-circular perimetral shape represented by a sinusoidal function having peaks and valleys at an angular frequency of either 12 or 36 degrees, in response to an air pressure burst.
Figure 7:
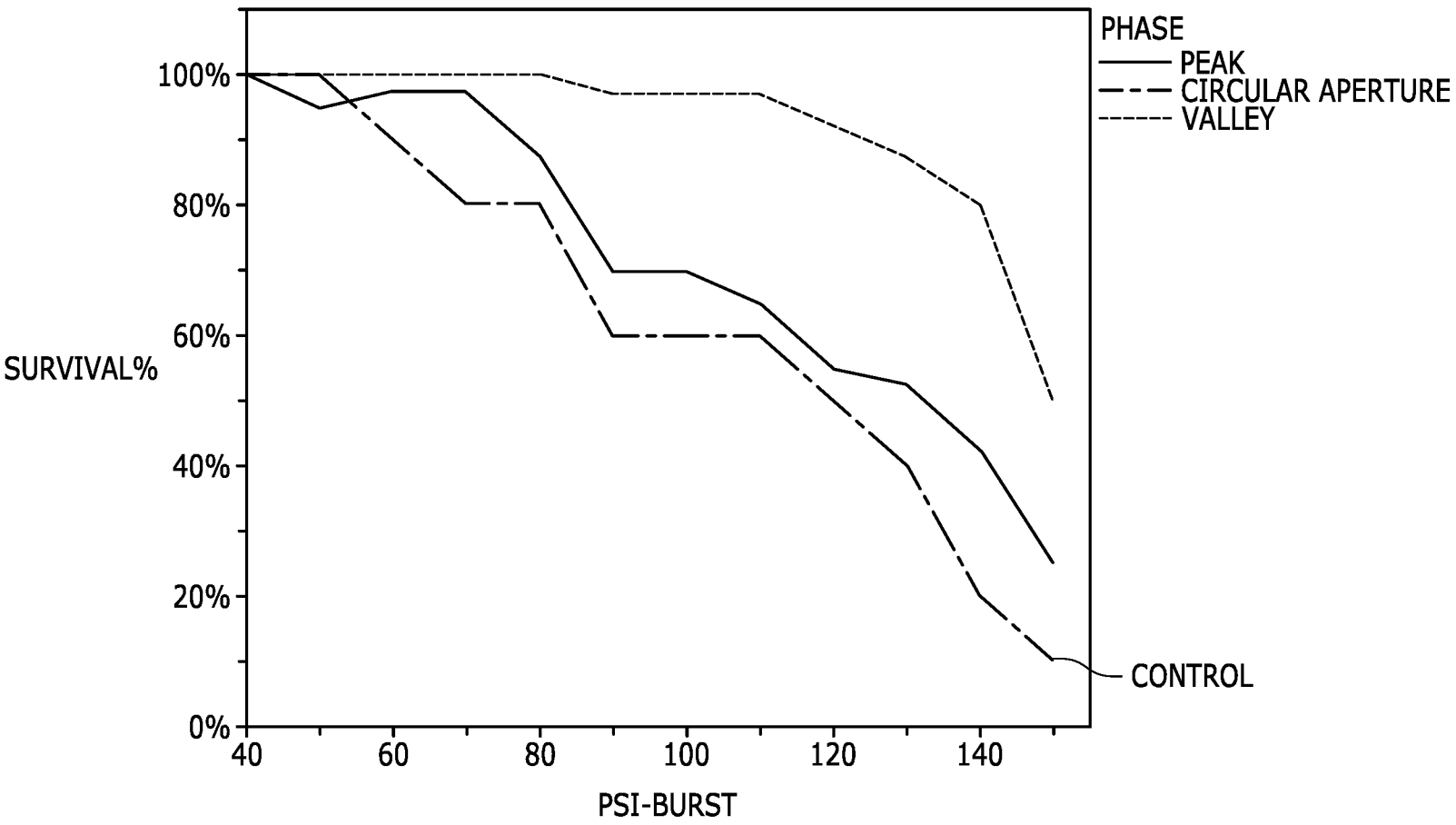
FIG. 7 are plots showing survival rates of diaphragms of acoustic transducers that include a circular aperture (control), or an aperture defining a non-circular perimetral shape represented by a sinusoidal function having peaks and valleys and diaphragm anchors aligned with either a peak or a valley of the aperture, in response to an air pressure burst.

FIGS. 5-7 show improvement in survival rate of acoustic transducers having sinusoidal shaped apertures having various amplitude, frequency, and anchor posts aligned with either a corresponding valley or a corresponding peak, respectively in comparison with similar acoustic transducers that have standard circular apertures (indicated as control in FIGS. 5-7). Survival rate was determined by performing physical measurements of an acoustic signal measured by a first set of acoustic transducers that included a circular aperture (control), and a second and third set of acoustic transducers that included non-circular apertures having various amplitude, frequency, and anchor posts aligned with either a corresponding valley or a corresponding peak, as described in each of FIGS. 5-7. Survival rate is described as the percentage of acoustic transducers within each set that continue to perform normally after exposure to an air burst test. As shown in FIGS. 5, 6 and 7, each of the acoustic transducers having a sinusoidal shaped aperture demonstrate a higher survival rate than the control acoustic transducer even at an air pressure burst of up to 150 psi. The acoustic transducer with sinusoidal shaped aperture having an amplitude of the peaks and valleys of 10 microns demonstrated a higher survival rate than the acoustic transducer with sinusoidal shaped aperture having an amplitude of 20 microns (FIG. 5). Furthermore, the acoustic transducer with sinusoidal shaped aperture having a frequency of the peaks and valleys of 36 degrees demonstrated a higher survival rate than the acoustic transducer with sinusoidal shaped aperture having a frequency of 12 degrees (FIG. 6). Moreover, the acoustic transducer having anchors posts radially aligned with a corresponding valley of the aperture demonstrated a higher survival rate than the acoustic transducer having the anchor post aligned with a corresponding peak of the aperture (FIG. 7).

Figure 8:
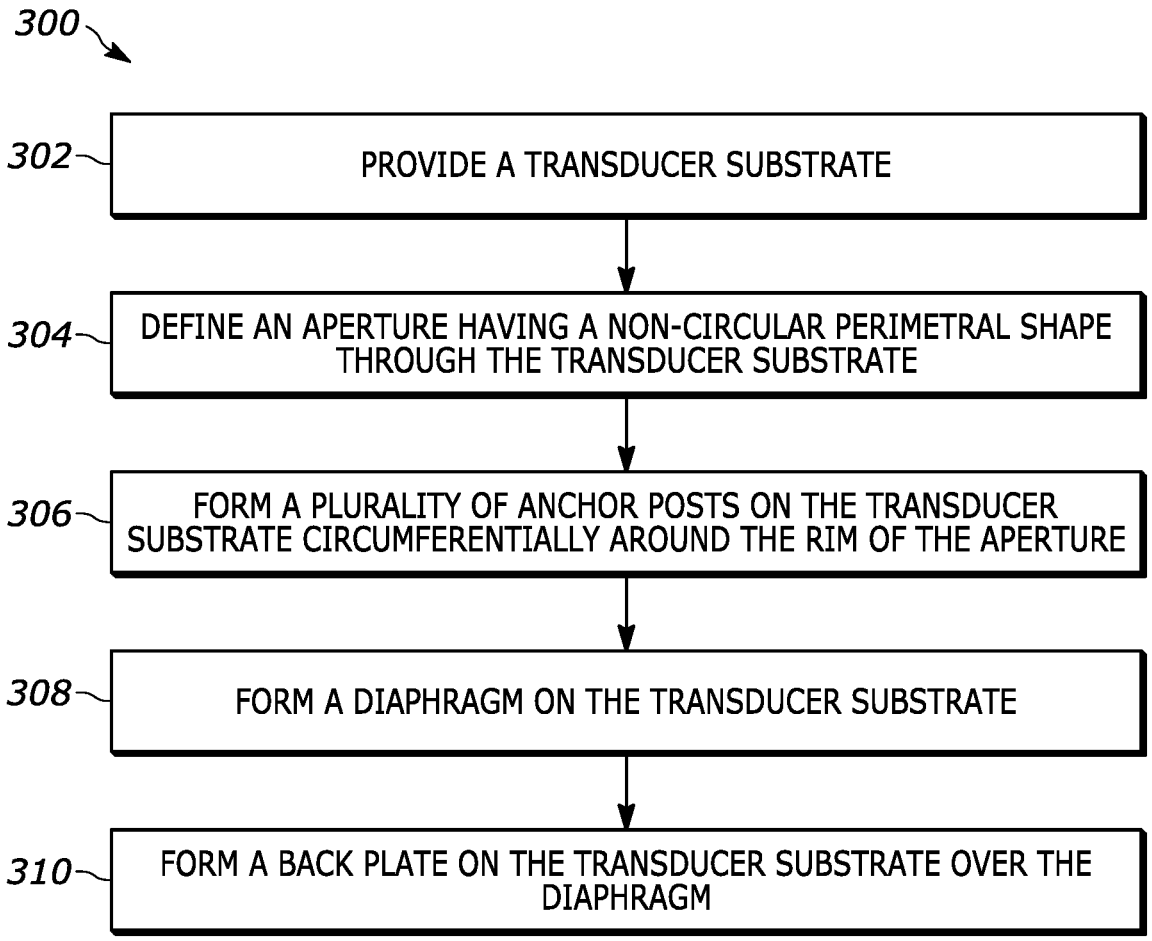
FIG. 8 is a schematic flow diagram of a method for forming an acoustic transducer, according to an embodiment.

FIG. 8 is a schematic flow diagram of a method 300 for forming an acoustic transducer (e.g., the acoustic transducer 110, 210), according to an embodiment. The method 300 includes providing a transducer substrate (e.g. the transducer substrate 112), at 302. At 304, an aperture having a non-circular perimetral shape (e.g., a sinusoidal shape) is formed through the transducer substrate. For example, the aperture 114 is formed through the transducer substrate 112. In some embodiments, the aperture may be formed using a deep reactive ion etching (DRIE) process (e.g., the Bosch process).

At 306, a plurality of anchor posts (e.g., the anchor posts 134) are formed circumferentially around rim of the aperture, for example, using a deposition and selective etching process. At 308, a diaphragm (e.g., the diaphragm 130, 230) is formed on the transducer substrate. For example, the diaphragm 130, 230 is formed on the transducer substrate 112 via a deposition process such as chemical vapor deposition (CVD), plasma enhanced CVD (PECVD), low pressure CVD (LPCVD), or any other deposition technique. At 310, a back plate (e.g., the back plate 140) is formed on the transducer substrate over the diaphragm.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

As used herein, the terms "approximately" generally mean plus or minus 10% of the stated value. For example, approximately 0.5 would include 0.45 and 0.55, approximately 10 would include 9 to 11, and approximately 1000 would include 900 to 1100.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An acoustic transducer, comprising:

a transducer substrate;

an aperture having a non-circular perimetral shape defined through the transducer substrate; and a diaphragm disposed over the transducer substrate and coupled to a surface of the transducer substrate via at least one diaphragm anchor such that a gap is defined between the diaphragm and the transducer substrate, and an outer edge of the diaphragm is located radially outwards of a rim of the aperture such that a portion of the diaphragm overhangs the aperture, wherein the non-circular perimetral shape is a sinusoidal shape such that a wall of the aperture defines a set of peaks and a corresponding set of valleys in a direction perpendicular to a longitudinal axis of the acoustic transducer.

2. The acoustic transducer of claim 1, wherein an amplitude of each of the set of peaks and the set of valleys is in a range of 5 microns to 50 microns, inclusive.

3. The acoustic transducer of claim 1, wherein an angular frequency of the set of peaks and the set of valleys is in a range of 4 degrees per second to 72 degrees per oscillation.

4. The acoustic transducer of claim 1, further comprising a plurality of anchor posts disposed on the transducer substrate circumferentially around the rim of the aperture, the anchor posts extending from the transducer substrate towards the diaphragm.

5. The acoustic transducer of claim 4, wherein each anchor post of the plurality of anchor posts is radially aligned with a corresponding valley of the set of valleys.

6. The acoustic transducer of claim 4, wherein each anchor post of the plurality of anchor posts is radially aligned with a corresponding peak of the set of peaks.

7. The acoustic transducer of claim 1, wherein a radial distance from the outer edge of the diaphragm to the rim of the aperture is in a range of 5 microns to 70 microns, inclusive.

8. The acoustic transducer of claim 1, wherein an axial distance between the diaphragm and the transducer substrate defined by the gap is in a range of 0.5 microns to 3 microns, inclusive.

9. The acoustic transducer of claim 1, further comprising a back plate disposed on the transducer substrate over the diaphragm.

10. A microphone assembly, comprising:

a base;

an enclosure disposed on the base;

an acoustic transducer disposed on the base within the enclosure, the acoustic transducer configured to generate an electrical signal responsive to acoustic activity, the acoustic transducer comprising:

a transducer substrate, an aperture having a non-circular perimetral shape defined through the transducer substrate, and a diaphragm disposed over the transducer substrate and coupled to a surface of the transducer substrate via at least one diaphragm anchor such that a gap is defined between the diaphragm and the transducer substrate, and an outer edge of the diaphragm is located radially outwards of a rim of the aperture such that a portion of the diaphragm overhangs the aperture, wherein the non-circular perimetral shape is a sinusoidal shape such that a wall of the aperture defines a set of peaks and a corresponding set of valleys in a direction perpendicular to a longitudinal axis of the acoustic transducer.

11. The microphone assembly of claim 10, wherein the acoustic transducer further comprises a back plate disposed on the transducer substrate over the diaphragm.

12. The microphone assembly of claim 10, wherein an amplitude of each of the set of peaks and the set of valleys is in a range of 5 microns to 50 microns, inclusive.

13. The microphone assembly of claim 10, wherein an angular frequency of the set of peaks and the set of valleys is in a range of 4 degrees per second to 72 degrees per oscillation.

14. The microphone assembly of claim 10, wherein the acoustic transducer further comprises a plurality of anchor posts disposed on the transducer substrate circumferentially around the rim of the aperture, the anchor posts extending from the transducer substrate towards the diaphragm.

15. The microphone assembly of claim 14, wherein each anchor post of the plurality of anchor posts is radially aligned with a corresponding valley of the set of valleys.

16. The microphone assembly of claim 14, wherein each anchor post of the plurality of anchor posts is radially aligned with a corresponding peak of the set of peaks.

17. The microphone assembly of claim 10, wherein a radial distance from the outer edge of the diaphragm to the rim of the aperture is in a range of 5 microns to 70 microns, inclusive.

18. The microphone assembly of claim 10, wherein an axial distance between the diaphragm and the transducer substrate defined by the gap is in a range of 0.5 microns to 3 microns, inclusive.

* * * * *